United States Patent [19]

Irish et al.

[11] Patent Number: 4,657,196

[45] Date of Patent: Apr. 14, 1987

[54] MECHANISM FOR SUPPORTING AND ROTATING A COIL

[75] Inventors: Joseph R. Irish, Davenport, Iowa; Robert L. Montieth, Port Byron, Ill.

[73] Assignee: Aluminum Company of America, Pittsburgh, Pa.

[21] Appl. No.: 700,652

[22] Filed: Feb. 11, 1985

Related U.S. Application Data

[63] Continuation-in-part of Ser. No. 647,023, Sep. 4, 1984, abandoned.

[51] Int. Cl.[4] ..... B21C 47/16; B65H 16/04; B65H 75/00

[52] U.S. Cl. ..... 242/55; 242/66; 242/78.6; 242/79; 414/910; 414/911

[58] Field of Search ..... 242/55, 66, 78.6, 79, 242/55.01; 414/433, 607, 684, 785, 910, 911, 912; 384/546, 549, 587

[56] References Cited

U.S. PATENT DOCUMENTS

| | | | |
|---|---|---|---|
| 326,955 | 9/1885 | Cool | 384/549 |
| 680,897 | 8/1901 | Sweeney | 384/549 |
| 951,288 | 3/1910 | Rennerfelt | 384/549 |
| 1,426,764 | 8/1922 | Parker | 414/911 X |
| 1,580,188 | 4/1926 | Wright et al. | 414/910 X |
| 1,591,248 | 7/1926 | Tracy | 414/910 X |
| 2,087,010 | 7/1937 | Wardle et al. | 242/78.6 X |
| 2,267,036 | 12/1941 | McArthur | 242/79 X |
| 2,398,879 | 4/1946 | Bouget | 242/66 X |
| 2,687,854 | 8/1954 | Lorig | 242/78.6 |
| 3,690,492 | 9/1972 | Shore | 414/607 |
| 3,811,638 | 5/1974 | Bruns | 242/78.6 |
| 4,005,793 | 2/1977 | Smith | 414/911 X |
| 4,306,826 | 12/1981 | Detwiler | 414/910 X |
| 4,451,198 | 5/1984 | Sanderson | 414/911 X |

*Primary Examiner*—John Petrakes

*Attorney, Agent, or Firm*—Max L. Williamson

[57] ABSTRACT

A mechanism for rotating a hollow coil of wound material about its longitudinal axis, the mechanism comprising one or more rollers affixed to a cantilevered support with the mechanism adapted for a telescope fit into the hollow interior of the coil. The rollers are capable of being rotated about their axes and are positioned and attached to the support so as to contact the interior surface of the coil with their axes parallel to the longitudinal axis of the coil whereby the coil may be rotated to wind or unwind material on or off of the coil.

10 Claims, 8 Drawing Figures

MECHANISM FOR SUPPORTING AND ROTATING A COIL

This is a continuation-in-part of application Ser. No. 647,023, filed Sept. 4, 1984, now abandoned.

BACKGROUND OF THE INVENTION

This invention relates to a mechanism for rotating a hollow cylindrical article, such as a coil of continuous sheet material, for example, about its longitudinal axis.

In the manufacture of continuous lengths of material, such as metal sheet, for example, the material is typically wound in a coil during the course of manufacture. Thereafter, it may be necessary to unwind at least a portion of the coil for such reasons as removal of one or more outer layers because of material defects or to check the quality of material within the coil underlying one or more of the outer layers. One mechanism which has been used heretofore for accomplishing such unwinding has been an upright pedestal having a freely rotating or power-driven mandrel cantilevered outwardly therefrom. The mandrel is adapted to engage a coil mounted thereon with a sufficient degree of tightness that the coil is rotated coincident with rotation of the mandrel. Another mechanism that has been used for unwinding coiled material is termed a "saddle". A saddle is comprised of spaced apart rollers having parallel axes of rotation which may be mounted on the floor or a supporting frame. The spacing of the rollers is such that they serve to support a coil that is placed upon them with the coil axis parallel to and centered between the roller axes. The rollers may be power driven to rotate the coil from frictional contact between the coil and the rollers or, if the rollers are free to rotate, material may be pulled from the coil and the roller supported coil is thereby rotated. Heretofore, if it were desired to unwind a coil, it has been necessary to transport the coil to such a just-described device. In many instances, such a transport unduly disrupts the normal processing of the material since the coil has to be moved from a work station to the rotate device, mounted thereon for unwinding and then transported back to the work station.

It would be desirable, therefore, to provide a mechanism for rotating a coil of material about its longitudinal axis which may be transported to the coil location and thereby minimize the time required to unwind the coil.

SUMMARY OF THE INVENTION

A mechanism of this invention is adapted to rotate a hollow coil about its longitudinal axis without contacting the coil exterior.

The mechanism comprises a cantilevered, substantially horizontal elongate support member having one or more rollers of a lesser diameter than the inside diameter of the coil attached thereto. The roller is positioned on the support member so as to contact an interior surface portion of a coil telescoped over the mechanism in a manner to uniformly support the coil along a single line of contact between the coil and the roller. If desired, the roller, or at least one of the rollers if more than one is used, may be power-driven to cause the coil to rotate. The support member may be cantilevered from a mount fixed to the floor, may be a cantilevered portion of a hook, such as a C hook, attached to an overhead hoisting device, or may be adapted to assemble with the load engaging tines of a forklift truck.

It is an objective of this invention to provide a mechanism to rotate a hollow coil of wound material about its longitudinal axis which is adaptable for attachment to a hoisting device or a stationary mount.

It is an advantage of this invention that it may be used to rotate such a coil about its longitudinal axis without contacting the object's exterior.

These and other objectives and advantages will be more apparent with reference to the accompanying drawings and the following description of a preferred embodiment.

DESCRIPTION OF A PREFERRED EMBODIMENT

For convenience, a preferred embodiment of this invention will be described as a mechanism for rotating a coil of continuous sheet material about its longitudinal axis.

Figure 2:
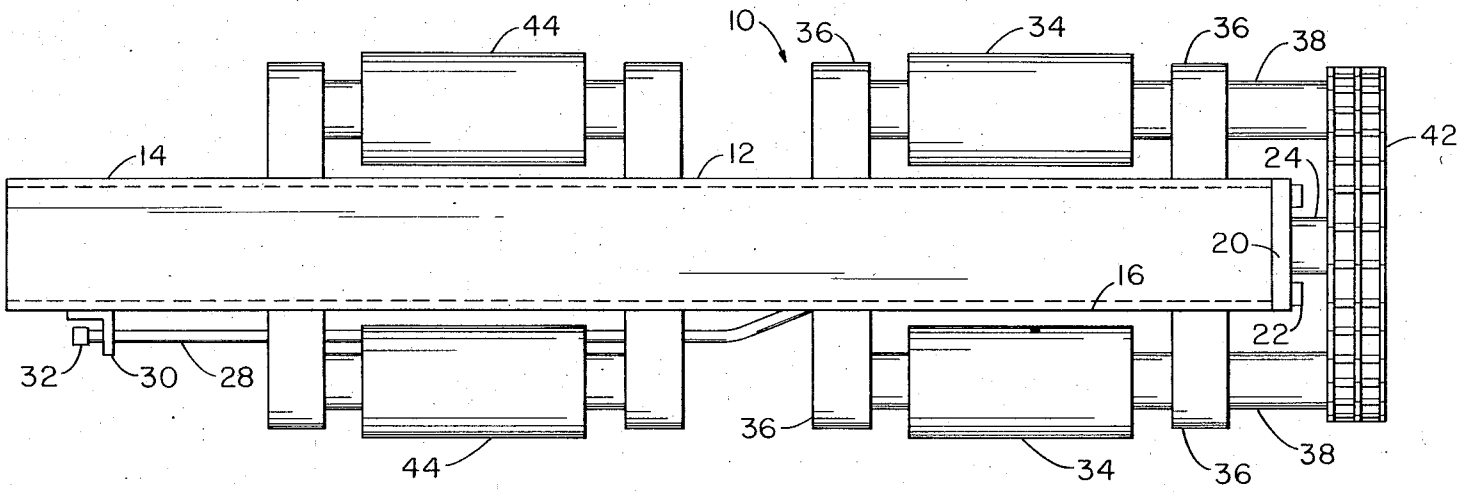
FIG. 2 is a top view of the mechanism shown in FIG. 1.
Figure 1:
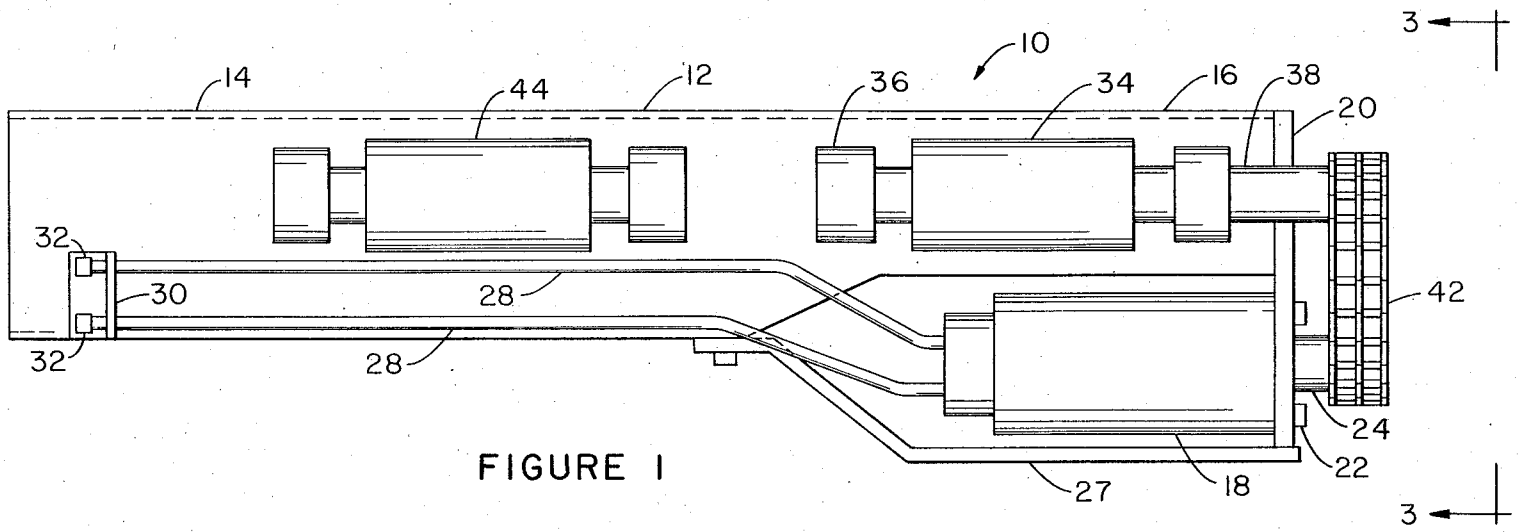
FIG. 1 is an elevation view of a preferred embodiment of a mechanism of this invention.
Figure 3:
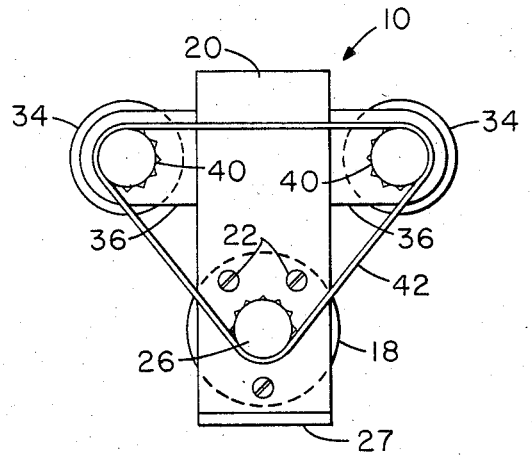
FIG. 3 is an end view of the mechanism shown in FIGS. 1 and 2 having a coil of material thereon.

Referring to FIGS. 1, 2 and 3, a rotate mechanism 10 of this invention includes a rectangular tubular support member 12. The support 12 has a rear portion 14 and front portion 16 of a lesser depth than the rear portion to provide for the accommodation of an air-driven motor 18 therebelow. A motor mount plate 20 is affixed to the front face of the support 12 by welding, for example, and the air motor 18 is attached to the motor mount plate with machine screws 22 with the motor centered along the vertical centerline of the support 12. The air motor shaft 24 extends through an opening in the mounting plate 20 and has a sprocket 26 on the end thereof. A formed sheet cover plate 27 attached to the support 12 by bolts is provided below the motor 18 to protect it from damage. Air supply and return lines 28 extend rearward from the motor to a support bracket 30 affixed to the side of the support 12. The terminal ends of the air lines 28 are provided with suitable fittings 32 for connection to a supply of compressed air.

Cylindrical drive rollers 34 with their axes parallel to the support 12 axis are mounted outwardly in a side-by-side relationship on each side of an upper front portion of the support to form an assembly having a width less than the internal diameter of a coil to be mounted thereon. Roller mounts 36 are attached to the support 12 outwardly from each end of the rollers 34, and the rollers are held therein by roller shafts 38 extending coaxially through the rollers. The roller mounts 36 are provided with bearing systems adjacent the shafts which are suitable for the anticipated use of the rotate mechanism 10. A roller sprocket 40 is attached to each of the shaft 38 ends. A continuous chain belt 42 is engaged with the air motor and drive roller sprockets 26, 40.

Idler rolls 44 in coaxial alignment with the drive rollers 34 are mounted on the rear portion 14 of the support 12 in a manner identical with that described for mounting the drive rollers. The position of the drive and idler rollers 34, 44 with respect to the support 12 and the spacing of the idler rollers from the drive rollers are functions of the interior dimensions of the coils to be handled. The width of the roller assembly is sufficient to provide uniform support to a coil and maintain the coil against any substantial rocking when the coil is mounted on the mechanism. The spacing of the idler rollers 44 from the drive rollers 34 is determined by the length of coil to be mounted on the rollers. The rollers may be made from any material having a wear-resistant quality and friction engaging characteristic suitable for its intended use. In using the mechanism to rotate coiled metal sheet material, for example, the rollers may be made of a hard rubber material.

A rotate mechanism of this invention may be attached to a stationary mount or attached to an overhead hoisting device, such as a movable overhead crane.

Figure 4:
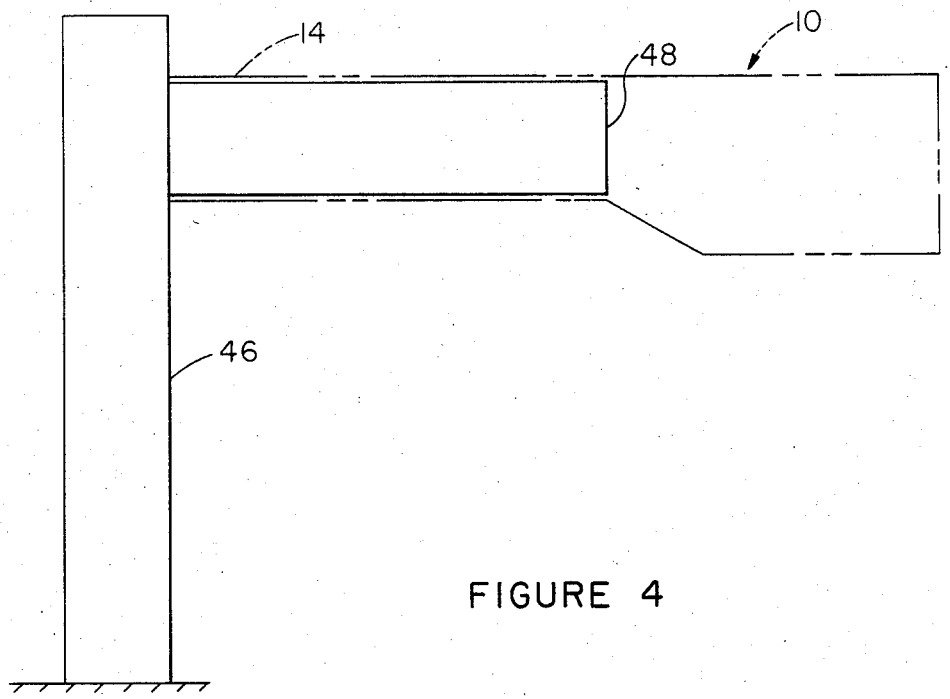
FIG. 4 is an elevation view of a floor mounted pedestal with the mechanism shown in FIG. 1 mounted thereon.

In FIG. 4, the rotate mechanism 10 is attached to a pedestal 46 which is anchored to the floor. Cantilevering outwardly from the pedestal 46 is an arm 48 which is adapted for a telescope fit into the hollow interior of the mechanism support 12. The structure of the pedestal 46 and arm 48 and the inward extent of the arm into the support is that which is suitable to support the weight of the coil to be mounted thereon. If desired, the mechanism 10 may be attached to the arm 48 by the use of machine bolts or welded to the pedestal 46.

Figure 5:
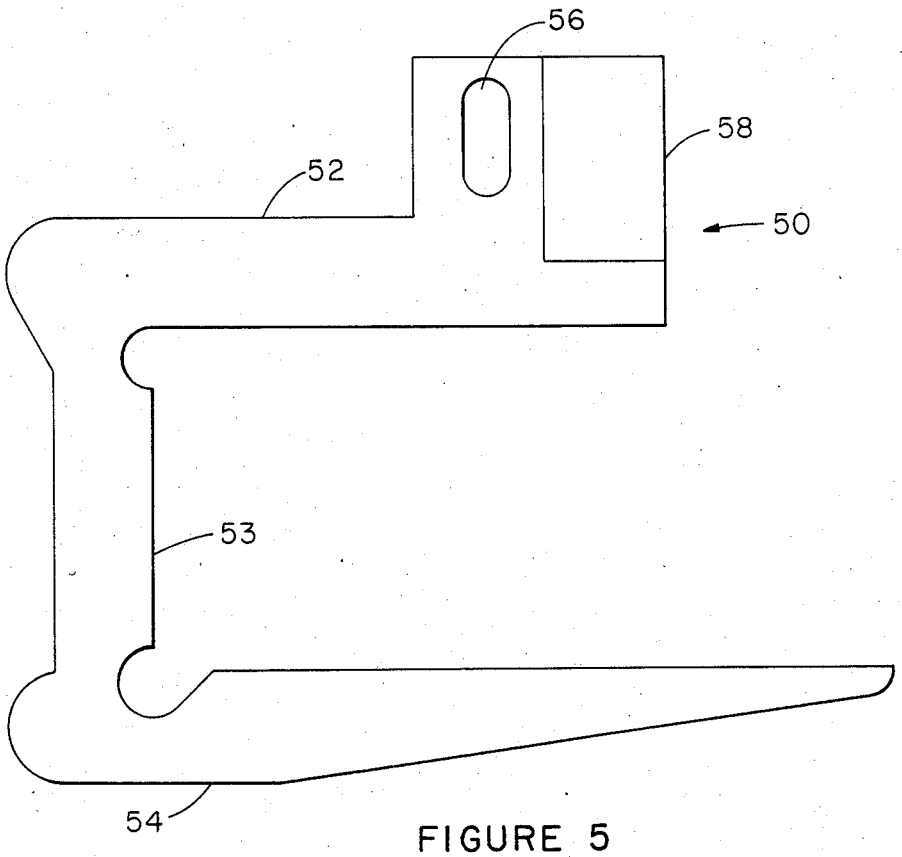
FIG. 5 is an elevation view of a C hook which may be used as a mount for a mechanism of this invention.

FIG. 5 shows a conventional C hook 50 as is presently used to transport coils with an overhead crane. The hook has an upper arm 52 and a lower arm 54 cantilevered from a portion 53 connecting the upper and lower arms. The upper arm 52 includes an eye 56 for engagement with a crane hook and a counterweight 58. The counterweight 58 is provided to maintain the lower hook arm in a substantially horizontal position after engagement with the rotate mechanism. To engage the hook 50 with a rotate mechanism of this invention, the lower arm 54 is telescoped into the hollow interior of the mechanism support.

Figure 6:
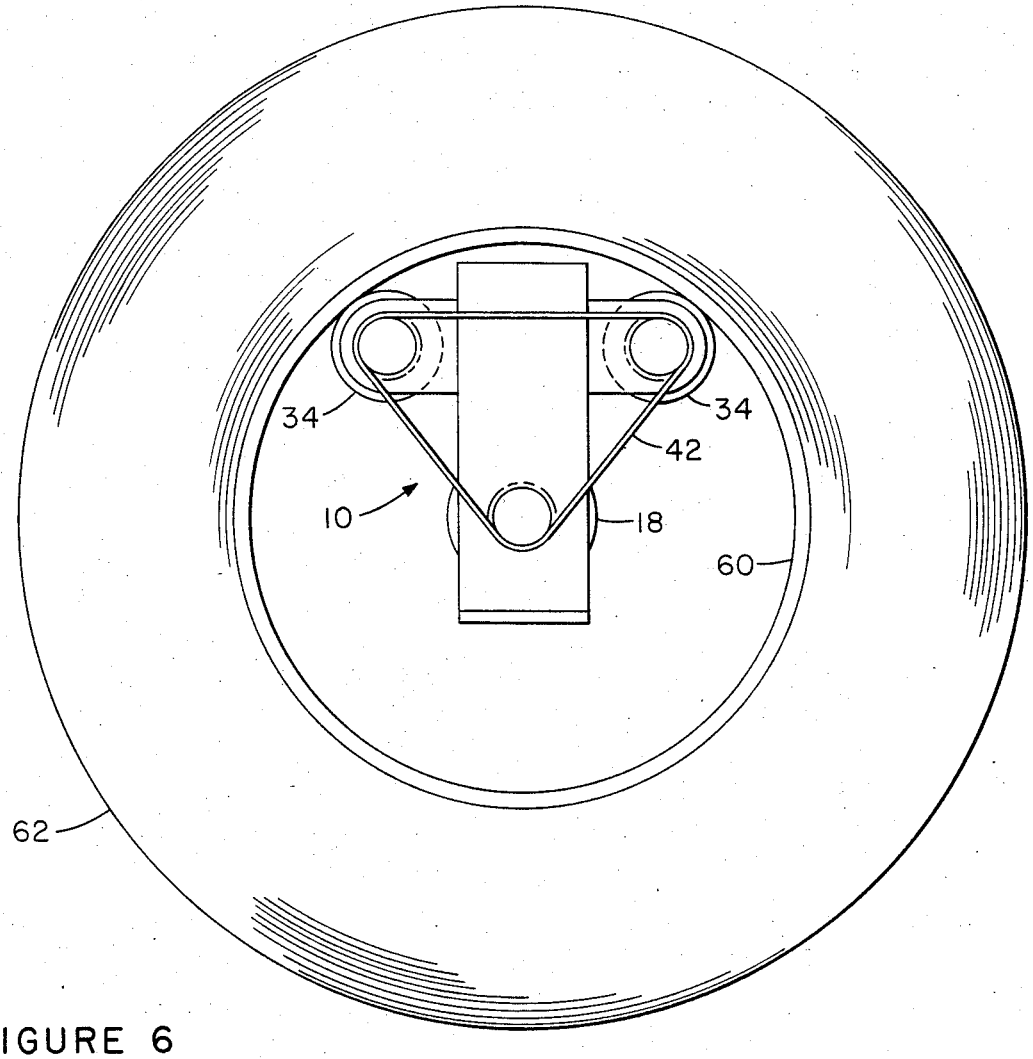
FIG. 6 is a view of the mechanism shown in FIG. 3 having a coil of wound sheet material mounted thereon.

Referring now to FIG. 6, a cylindrical spool 60 having sheet coiled therearound is shown in engagement with the rotate mechanism 10. Coiled sheet materials are often wound on spools during the course of manufacture, but the mechanism may also be used with an unspooled coil, provided the coil interior is sufficiently smooth. To position a spool 60 having sheet coiled therearound on a floor mounted mechanism 10, the coil may be telescoped over the mechanism by the use of a forklift truck, for example. If the mechanism 10 is engaged with a C hook attached to an overhead crane, the hook is freely telescoped into the spool interior, the crane is activated to contact the rollers against the spool and raise the coil free of external support. To rotate the coil, the motor 18 is energized to rotate the drive rollers 34 in a desired direction. Frictional engagement between the drive rollers and the coil interior then causes the coil 62 to rotate without causing any substantial rocking of the coil.

It is apparent that the just-described embodiment may be varied in a number of ways within the scope of this invention. For example, the drive rollers 34 may be extended and thereby supply the total support for the coil without the need for idler rollers 44. In another variation, the rotational drive from the motor may be supplied to only one of the drive rollers 34 with the other roller being an idler roller. In yet another variation, if the mechanism is to be permanently affixed to a pedestal, the motor may be removed from the mechanism and located on or adjacent the pedestal. It is also apparent that a C hook or the arm 48 attached to the pedestal could be adapted for direct attachment of the rollers 34, 44 and the motor 18. The foregoing are but a few examples of embodiment variations within the scope of this invention.

Figure 7:
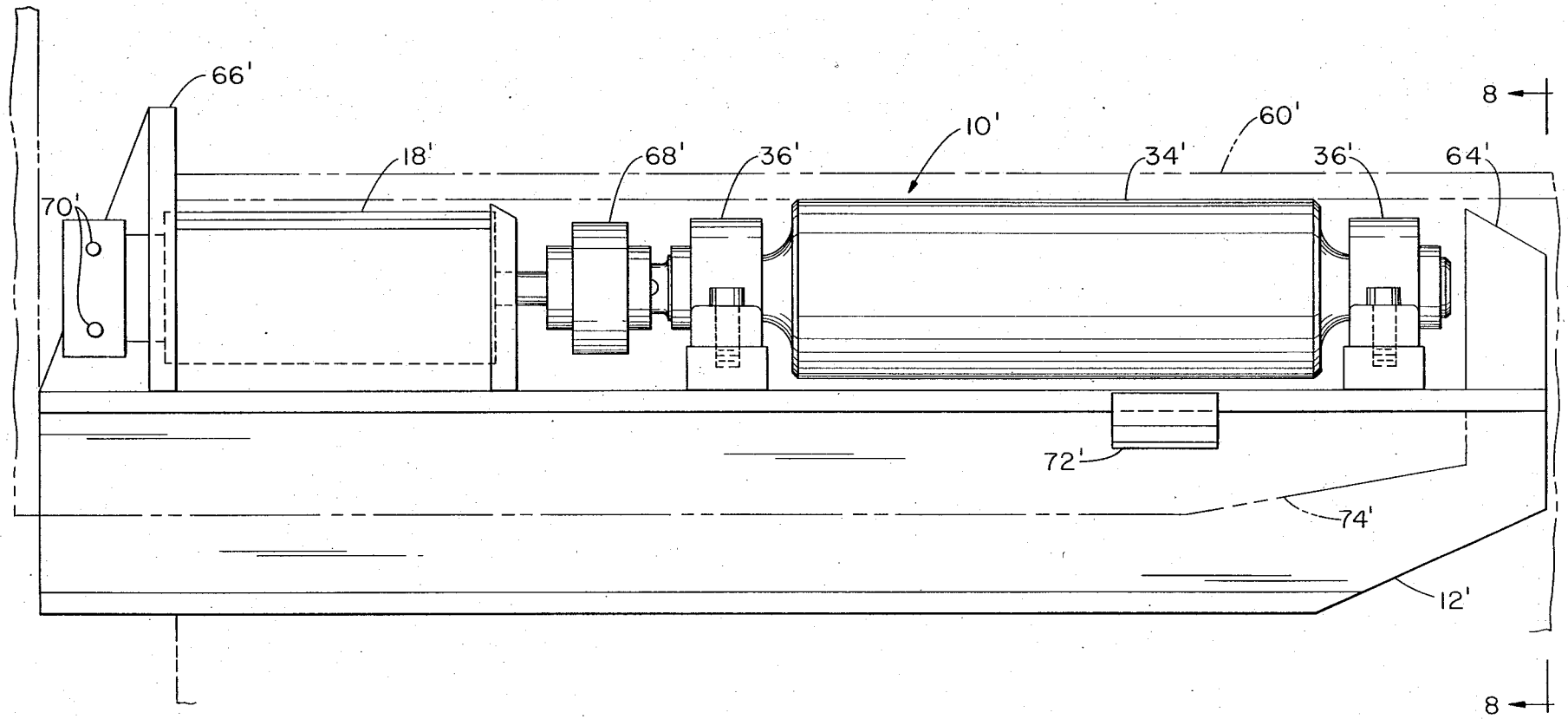
FIG. 7 is an elevation view of an alternate embodiment of a mechanism of this invention.
Figure 8:
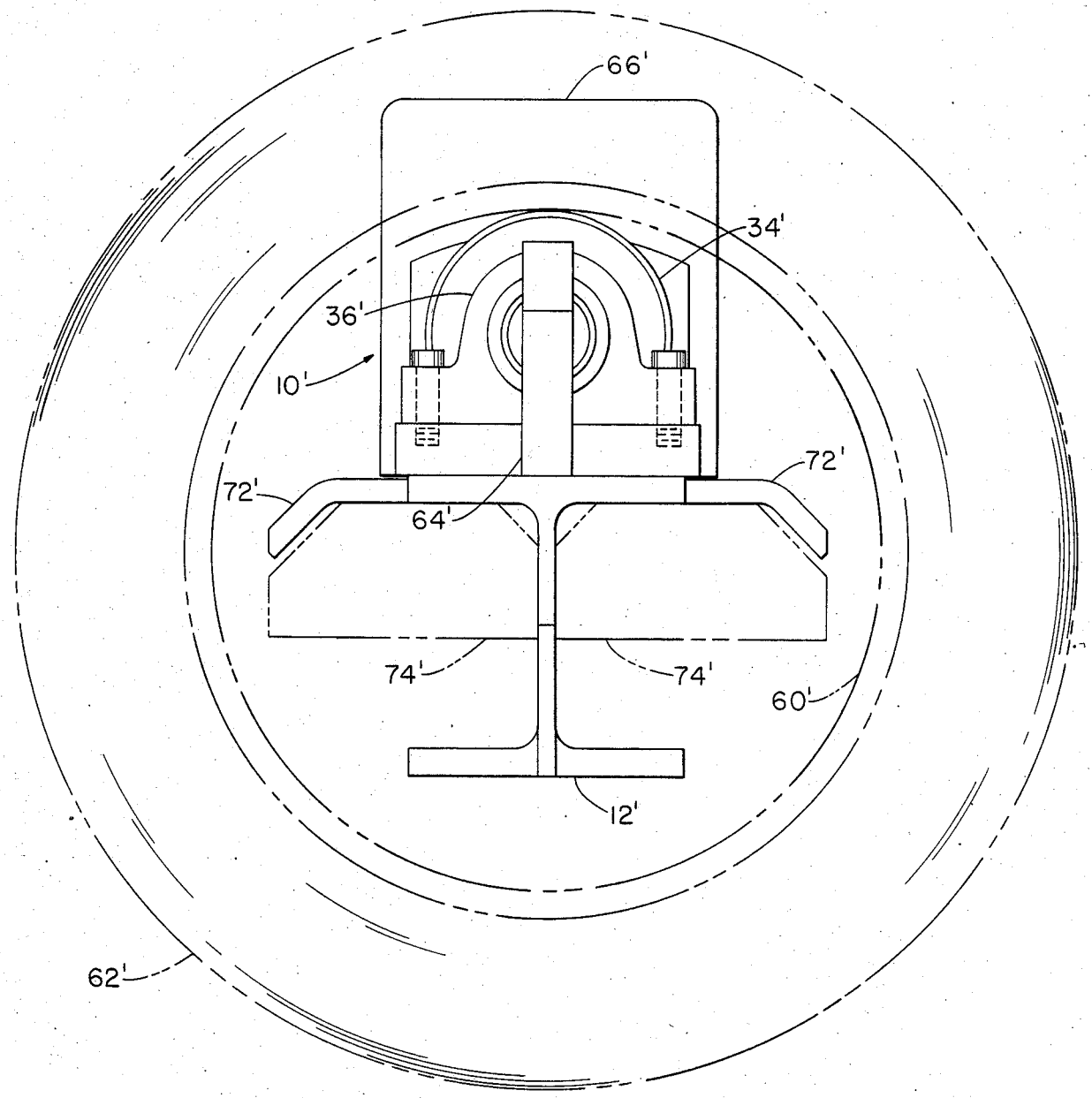
FIG. 8 is an end view of the mechanism shown in FIG. 7 having a coil of material thereon.

In an alternate embodiment, a mechanism of this invention may have only a single support roll, such as shown in FIGS. 7 and 8. Even though an embodiment having a single support roll does not offer the same degree of coil stability as a mechanism having two or more rollers, it may be used and it is particularly advantageous for use with a powered material handling vehicle, such as a forklift truck, for example. The out-to-out width of the fork may be such as to preclude or make it impractical to provide a two-roller coil support assembly above the forks. In such a case, the single support roll mechanism shown in FIGS. 7 and 8 is advantageous.

A wide flange beam support 12' has a single support drive roll 34' mounted thereon along the centerline on the top flange adjacent the front end. The roller is mounted in front and rear roller mounts 36' which include suitable bearings for the intended use of the mechanism and which are firmly attached to the wide flange beam. Outward of the roller 36' on the front end of the support member 12', an angled plate 64' is attached along the centerline of the support member to protect the roller during handling of the mechanism.

A formed plate motor housing 66' is attached to the support member 12' to the rear of the roller and adjacent the rear end of the member for mounting an air motor 18' therein. Shafts from the air motor and roller are connected by a coupling 68' and air supply and return fittings 70' are mounted on the rear of the motor housing for connection to a source of compressed air. At least one pair of formed plate clips 72' are attached along outer upper edges of the support member 12' to function as guides or retainers for the forks 74' of the vehicle upon which the mechanism 10' is mounted.

To use the mechanism to wind or unwind a coil of material, the mechanism is mounted on the forks 74' of the vehicle and telescoped into an end of a spool 60' having sheet material 62' coiled therearound. The coil is then raised in the air by raising the forks 74' having the mechanism 10' mounted thereon and roller 34' then supports the coil. By actuating the motor 18' with the air supply source connected to the fittings 70', the coil can then be rotated to either wind or unwind material. Since the coil is supported along only a single line of contact with the support roll 34', it may be susceptible to rocking or swinging when the roller is activated. It has been found, however, that a single support roll mechanism can be operated successfully for its intended purpose by exercising care in the speed of its operation.

What we claim is:

1. A mechanism adapted for attachment to hoisting and transporting apparatus for unwinding material from a coil, comprising:

a coil engaging member having an unobstructed and unsupported end for insertion into the hollow core of a coil of wound material having a horizontal axis of rotation;

a roller attached to the coil engaging member, the roller being rotatable about its own axis and having an outer surface to tangentially contact the core surface of a coil to be unwound; and means for attaching the coil engaging member to a hoisting and transporting apparatus for the purpose of moving the coil engaging member upward within the core and making tangential contact between the roller outer surface and the core surface and thereby enable the coil to be supported by the roller and have material unwound therefrom by rotating the roller.

2. A mechanism as claimed in claim 1 which further comprises an additional roller with the two rollers side by side in parallel relationship with the rollers forming an assembly having a width less than the inside diameter of the coil to be supported thereon.

3. A mechanism as claimed in claim 2 wherein said rollers are spaced apart.

4. A mechanism as claimed in claim 1 wherein the roller is connected to power means for rotating said roller.

5. A mechanism as claimed in claim 4 wherein said power means is connected to said mechanism.

6. A mechanism for supporting and rotating a coil of material about its longitudinal axis when suspended in the air on the forks of a forklift vehicle, comprising:

an elongate support member having means for connection with forks extending outwardly from a forklift vehicle;

a roller having an outside surface connected to the support member with the roller being rotatable about its axis and disposed upon the support member so that the outer surface tangentially contacts the interior surface of and supports a coil of material when the mechanism is inserted into the core of the coil.

7. A mechanism as claimed in claim 6 which further comprises a power means for driving the roller.

8. A mechanism for supporting and rotating a coil of material about its longitudinal axis when suspended in the air from an overhead crane, comprising:

a support member having means for attachment to a load engaging means depending from the hoisting portion of the overhead crane;

at least two rollers having parallel axes and forming an assembly having a width less than the diameter of the coil to be supported and rotated, said assembly being attached to the support member in a manner that the roller axes are parallel with the coil axis and the rollers are in supportive tangential contact with the interior surface of the coil when the coil is positioned on the mechanism so that material may be wound on or off of the coil by rotation of the rollers about their own axes.

9. A mechanism as claimed in claim 8 which further comprises power means to drive at least one roller.

10. A mechanism as claimed in claim 9 wherein the power means is attached to the support member.

* * * * *